United States Patent [19]

Johnson

[11] Patent Number: 4,581,800

[45] Date of Patent: Apr. 15, 1986

[54] METHOD OF MAKING A SEGMENTED EXTERNALLY FINNED HEAT EXCHANGER TUBE

[75] Inventor: Richard G. Johnson, Dowagiac, Mich.

[73] Assignee: Sundstrand Heat Transfer, Inc., Dowagiac, Mich.

[21] Appl. No.: 641,472

[22] Filed: Aug. 16, 1984

[51] Int. Cl.[4] ..... B21D 53/02; B21C 37/22; B23P 15/26; F28F 1/36

[52] U.S. Cl. ..... 29/157.3 AH; 29/157.3 A; 29/157.3 B; 165/184

[58] Field of Search ..... 29/157.3 R, 157.3 A, 29/157.3 AH, 157.3 V, 157.3 B, 157.3 D, 240, 240.5, 726, 727; 165/146, 184

[56] References Cited

U.S. PATENT DOCUMENTS

| | | | |
|---|---|---|---|
| 2,372,795 | 4/1945 | Rodeck | 29/727 X |
| 3,225,424 | 12/1965 | Wiley | 29/157.3 AH |
| 3,288,209 | 11/1966 | Wall et al. | 29/157.3 AH X |
| 3,362,058 | 1/1968 | Morris et al. | 29/157.3 AH |
| 4,143,710 | 3/1979 | La Porte et al. | 29/157.3 AH |
| 4,184,544 | 1/1980 | Ullmer | 29/157.3 AH |
| 4,236,578 | 12/1980 | Kreith et al. | 29/157.3 AH X |
| 4,336,642 | 6/1982 | Engelberts | 29/157.3 A |
| 4,416,223 | 11/1983 | Hashizume | 165/146 X |

FOREIGN PATENT DOCUMENTS

| | | | |
|---|---|---|---|
| 2840744 | 3/1980 | Fed. Rep. of Germany | 29/157.3 AH |

*Primary Examiner*—Howard N. Goldberg
*Assistant Examiner*—Ronald S. Wallace
*Attorney, Agent, or Firm*—James A. Wanner; Ted E. Killingsworth; Harold A. Williamson

[57] ABSTRACT

A method of making a segmented externally finned tube with at least one fin free area for use in a heat exchanger. The method includes the steps of providing a tape of thermally conductive material with spaced reliefs along one longitudinal edge thereof and slitting the tape from that edge partially across its length between the reliefs. The slit portions of the tape are bent to form an angle with respect to the remainder of the tape which is then used to helically wrap a thermally conductive tube. The area of the reliefs provide fin free areas.

12 Claims, 7 Drawing Figures

METHOD OF MAKING A SEGMENTED EXTERNALLY FINNED HEAT EXCHANGER TUBE

FIELD OF THE INVENTION

This invention relates to a heat exchanger employing, as part of a heat exchanger core, segmented, externally finned tubes, and more particularly, to a method of making such tubes.

BACKGROUND OF THE INVENTION

Segmented externally finned tubes employed in heat exchangers have proved to be quite successful as regards other types of finned heat exchanger tubes. The segmented fins appear as radially outwardly extending spines located about the periphery of the tube and along the length thereof. Because of the segmentation of the fins, a high degree of turbulence in the fluid, typically air, passing across such fins is generated; and such turbulence in segmented fins is much greater than that in heat exchangers using otherwise identical, smooth finned tubes. Because, in externally finned heat exchanger tubes, the overall heat transfer coefficient is largely controlled by the air or fluid side heat transfer coefficient, the greater degree of turbulence found in segmented fin structure provides for greater heat transfer because of an enhanced heat transfer coefficient.

In the usual case, segmented fins are applied to a tube by helically winding a tape formed of heat conductive material about the tube to be in heat transfer relation thereof. One edge of the tape is generally transversely slit while the other edge is continuous. The slit edge is bent at approximately right angles to the unslit edge before or during the winding process with the result that the slits delineate the spines which fan out and extend generally radially outwardly through an arc length of 360° about the tube.

In commonly assigned copending applications of David T. Hill, Ser. No. 06/641,476 filed Aug. 16, 1984, and Robert P. Failing, Ser. No. 06/641,474 filed Aug. 16, 1984, and entitled "Segmented Fin Heat Exchanger Core" and "Heat Exchanger Core and Heat Exchanger Employing the Same", respectively, the details of which are herein incorporated by reference, there are disclosed improvements in prior art segmented externally finned heat exchanger cores. As more fully stated in those applications, by providing one or more spine free areas on the tubes, i.e., by eliminating the spines forming parts of the segmented fin in various areas of the tube, heat exchange capability very nearly equal to that obtainable with prior art structures having spines throughout a 360° arc length is obtainable while at the same time several advantages over such prior art constructions are obtained. For example, the elimination of the spines in certain areas cuts almost by 50% the amount of material required in forming the spines with but negligible loss in heat transfer capability. Moreover, heat exchanger arrays employing tubes having spine free areas may be more compactly arranged providing for size advantages. Finally, the elimination of the spines in some areas on the tubes somewhat lowers the so-called "air side pressure drop" across a heat exchanger core such that less energy is required to maintain the desired air flow across the heat exchanger core.

This invention is directed to a method of forming segmented externally finned heat exchanger tube having spine free areas of the types disclosed in those copending applications in a most economical fashion.

SUMMARY OF THE INVENTION

This invention relates to a method of making segmented, externally finned tubes for use in heat exchangers, and more specifically, to a method of making such tubes where the same are provided with fin free areas.

An exemplary embodiment of the invention contemplates a method of making such a segmented externally finned tube which includes the steps of providing a tape of thermally conductive material with spaced reliefs along one longitudinal edge thereof while slitting the tape from the one edge partially across its length between the reliefs. The slit portion of the tape is then bent to form an angle with respect to the remainder of the tape to form finned areas. A thermally conductive tube is helically wrapped with the tape such that the slit portions of the tape extend outwardly from the tube and the remainder of the tape is in heat transfer relation with the tube.

According to a preferred embodiment of the invention, the steps of bending and wrapping are performed in sequence with the step of wrapping following the step of bending.

The invention contemplates that the tube employed in the wrapping step be of generally circular cross section.

In a highly preferred embodiment, the slit portions between the reliefs are of equal length along the length of the tape as are the reliefs. The sum of the lengths along the length of the tape of one slit portion and one relief is approximately equal to the periphery of the tube divided by an integer of one or more. In a highly preferred embodiment, the integer is 1 or 2, and the lengths of the reliefs and the lengths of the slit portions are equal to each other.

A highly preferred embodiment of the invention contemplates the steps of providing, between the longitudinal edges of an elongated sheet of thermally conductive material, a series of slits extending in a direction across the sheet and forming, inwardly of the longitudinal edges of the sheet, longitudinal cuts along the ends of the slits in alternating fashion on opposite sides of the sheet. The sheet is separated into two tapes along the longitudinal cuts and certain of the slits. The slit portions of each of the tapes are bent to form an angle with respect to the remainder of the respective part. The finned tube is formed by helically wrapping both of the tapes on at least one thermally conductive tube such that the slit portions extend outwardly therefrom and the remainders of each of the tapes are in heat transfer relation with the tube on which they are wound.

Preferably, the longitudinal cuts are all of equal length so that both tapes are identical, one to the other.

Other objects and advantages will become apparent from the following specification taken in connection with the accompanying drawings.

DESCRIPTION OF THE PREFERRED EMBODIMENT

Figure 1:
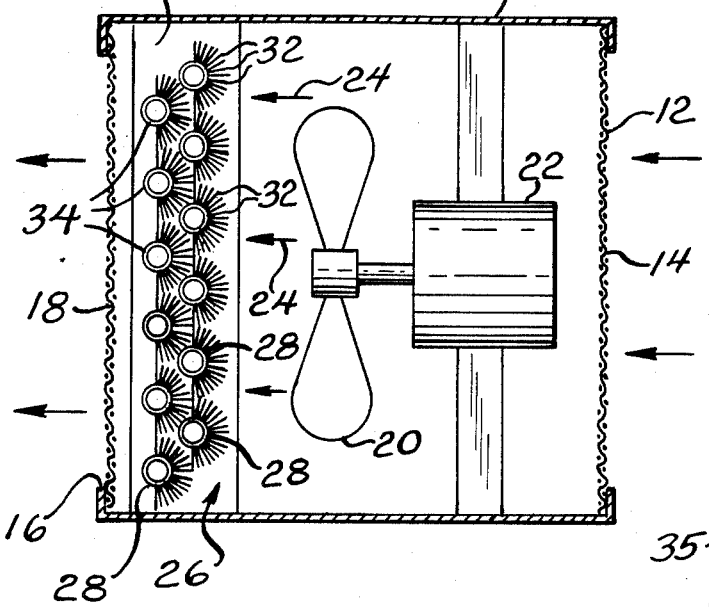
FIG. 1 is a somewhat schematic, partial sectional view of a heat exchanger embodying a core which may be made according to the method of the present invention.

One form of a heat exchanger core that may be formed utilizing the method of the present invention is illustrated in a typical environment in which it may be used in FIG. 1. It includes a housing 10 having an open inlet 12 closed by wire mesh 14 or the like in a similar outlet 16 spaced from the inlet 12 and also partially closed by mesh 18. The housing 10 thus defines a flow path between the inlet 12 and the outlet 16 and may contain a rotary fan 20 driven by a motor 22 for driving air in the direction of arrows 24 along the flow path.

On the outlet side of the housing, and downstream from the fan 20, is a heat exchanger core, generally designated 26 which may be made according to the method of the present invention. The core 26 has plural tubes 28 formed of heat conductive material with the tubes in differing rows being on staggered centers.

The tubes 28 are adapted to carry a heat exchange medium that is to be subjected to a heat exchange operation within the heat exchanger 10 which can be either heating or cooling of fluid contained in the tubes 28. The tubes 28 are mounted in the heat exchanger 20 at right angles to the flow path shown by arrows 24 therein by any suitable means such as a plate 30. Other angular configurations could be employed if desired.

Each of the tubes 28 is externally finned with segmented fins and carries spines 32 formed of heat conductive material. As illustrated in FIG. 1, the spines 32 on each tube 28 fan radially outwardly in a single, longitudinally extending group and are located on the upstream sides of the tubes 28. A downstream side 34 of each of the tubes 28 is spine free. However, as will be seen, the spines 32 could be located on the downstream side of the tubes 28 with a spine free area 34 being provided on the upstream side. Furthermore, other arrangements of the spines 32 and spine free areas 34 on the tubes can likewise be employed if desired and the method of the present invention is adaptable to any such arrangement.

Figure 2:
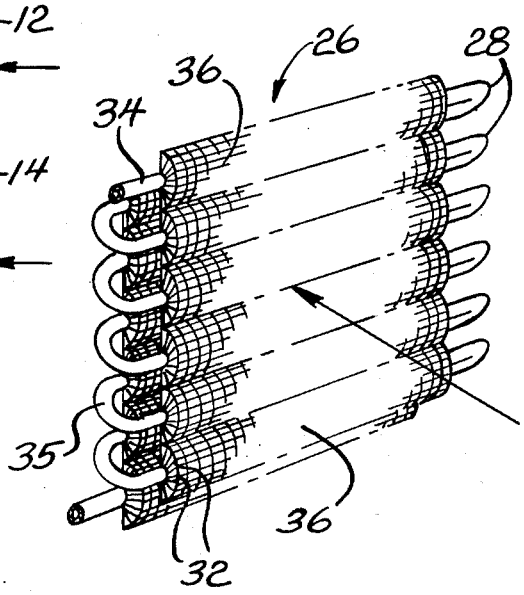
FIG. 2 is a perspective view of a multiple tube core employed in the heat exchanger of FIG. 1.

Turning now to FIG. 2, the core 26 is shown in perspective and it will be seen that the tubes 28 are in fact defined by a single elongated tube 35 wound generally in a serpentine fashion to provide two rows of the tubes 28 with the tubes 28 in one row being staggered with respect to the tubes 28 in the other as mentioned previously. Each run of the tube 35 carries a longitudinally extending row 36 of the spines 32 along its length. Preferably, each row 36 is parallel to the axis of the corresponding tube run 28.

Oppositely of each row 36 of the spines, the tubes have the longitudinally extending spine free areas 34. The spine free areas 34 again preferably are parallel to the axis of the corresponding run of the tube 35.

Figure 3:
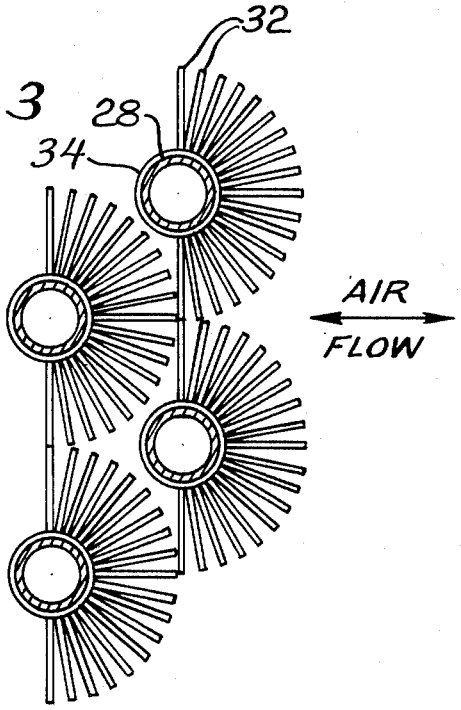
FIG. 3 is an enlarged, sectional view of a portion of the core.

As seen in FIG. 3, the spines 32 extend about an arc length of approximately 180° about the corresponding tube 28 and the spine free area 34 has an identical arc length of approximately 180°. However, while it is preferable that the spine free areas 34 and the arc length of the spines 32 be equal, that need not always be the case. For example, the arc length of the tube 28 provided with the spines 32 may range from about 180° to approximately 220°. Accordingly, the arc length of the spine free area 34 will be in the range of approximately 180° to about 140°.

As more fully stated in the previously identified copending applications, the spine free areas 34 may be located in areas where poor heat exchange efficiency occurs. For example, for the configuration illustrated in FIG. 3, if the direction of air flow is from right to left, the spine free areas 34 are located where recirculation zones of low velocity are typically found on the downstream side of the tubes 28. Thus, no heat transfer material used for forming the spine 32 is located in such area providing a material savings with very little sacrifice in heat exchange efficiency.

Alternatively, if the direction of air flow is from left to right as viewed in FIG. 3, the spine free areas 34 result in the absence of heat transfer material in upstream areas near the center of the tubes 28 whereat there would be low velocity near the roots of fins in conventional construction with accompanying low heat transfer efficiency. Again, material is saved.

In either case, the heat transfer per unit of fin material is increased 85–95% over that found in prior art structures.

Figure 4:
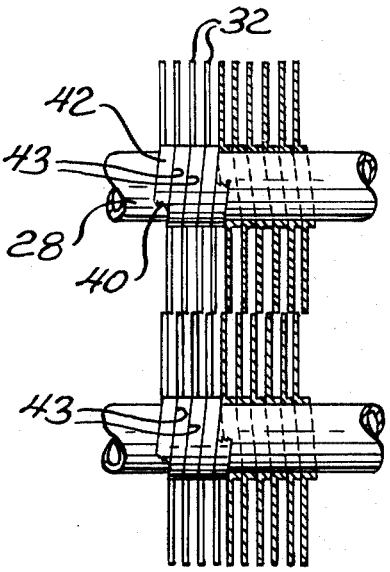
FIG. 4 is a fragmentary view along the flow path of one form of core than may be made according to the method of the present invention.

As seen in FIGS. 3 and 4, the spines 32 are formed in fanned relation on the tubes 28 by helically wrapping a heat conductive tape 40 about the tubes 28. The tape 40 has a base portion 42 which is wrapped about the tubes 28 with adjacent convolutions being in substantial abutment as seen in FIG. 4 and the spines 32 are bent approximately 90° from the base 42 to extend substantially radially of the tubes 28. In the spine free areas 34, the tape is provided with reliefs 43 extending to the base 42 creating an absence of the spines, i.e., a spine or fin free area.

Figure 5:
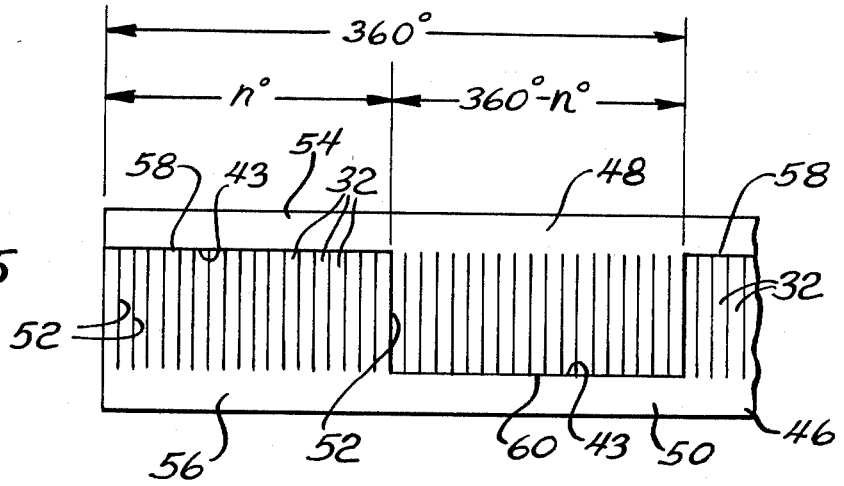
FIG. 5 is a plan view of a partially formed tape employed in the method for forming segmented external fins on the tubes of the core.

According to the invention, one preferred method of providing the tubes with alternating rows of spines 36 and spine free areas 34 will be described in connection with FIGS. 4 and 5. Referring to FIG. 5, there is provided a thin sheet 46 of heat conductive material such as aluminum or the like to form the tape 40. Opposite longitudinal edges of the sheet 46 are shown at 48 and 50 and between the longitudinal edges 48 and 50 there are provided a series of slits 52 which extend partially across the sheet 46. The slits 52 do not extend to the longitudinal edges 48 and 50 thereby leaving functionally continuous portions 54 and 56 on opposite longitudinal edges of the tape which ultimately form the base 42 which is wrapped about the tube 28 as seen in FIG. 4, while the slits 52 ultimately define the spines 32.

Longitudinal cuts 58 and 60 are formed along the opposite ends of the slits 52 in alternating fashion on opposite sides of the tape 46 as seen in FIG. 5. It will be observed that the righthand end of each cut 58 intersects one of the slits 52 which also intersects the lefthand end of a cut 60 and vice versa. As a consequence of this construction, the sheet 46 may be separated into two tapes along the longitudinal cuts and the slits which are intersected by both a cut 58 and a cut 60. Each cut 58 will have an arc length of n° while each cut 60 will have an arc length of 360°−n°.

Each tape formed from the sheet will then have one functionally continuous edge as at 54 or 56 and the opposite edge will have a series of spines 32 extending therefrom in a plurality of groups with each group being separated from adjacent groups by a relief 43 defined by one or the other of the longitudinal cuts 58 or 60 as the case may be. The spines 32 on each such tape may then be bent to approximately right angles to the functionally continuous part 54, 56 and the latter then wound about a tube as mentioned previously in connection with the description of FIG. 4. Preferably, the sum of the length of one of the cuts 58 and one of the cuts 60 will be approximately equal to the circumference of the tube, that is approximately equal to an arc length of 360°. As a consequence, the winding of the part around one of the tubes will result in a longitudinal row of spines 32 as well as a longitudinally extending spine free area 34 as illustrated in FIGS. 1–3.

As shown in FIG. 5, according to a highly preferred embodiment, the cuts 58 and 60 are also of equal length, each having a length corresponding to an arc length of approximately 180° about a tube 28. As a consequence, when the sheet 46 is divided into two parts, two identical tapes will be formed. Each of the tapes may be wrapped about one or more of the tubes 28 to form a segmented externally finned tube for use in a heat exchanger as illustrated in FIGS. 1–3. It will be appreciated that when both of the tapes are identical, the entirety of the sheet 46 is used and there will be no need to reclaim or recycle material removed from the sheet 46 in forming the reliefs 43.

Figure 6:
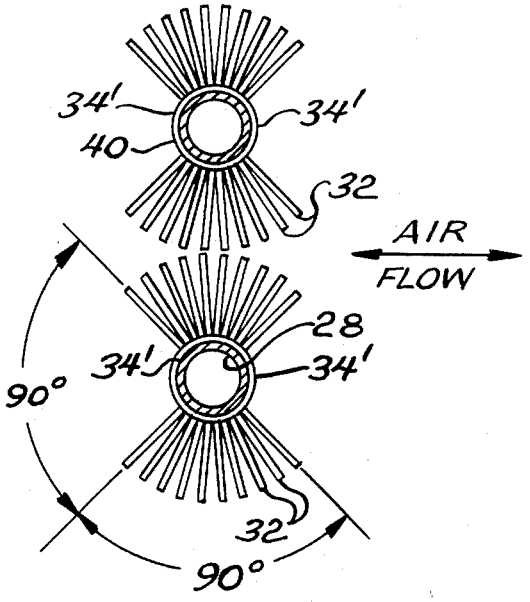
FIG. 6 is a view similar to FIG. 3 but illustrating a different configuration of segmented fins on a tube.

FIG. 6 illustrates an alternative form of a segmented, externally finned tube for use in heat exchangers. In this embodiment, the spines 32 are located on opposite sides of the tube 28 in relation to the direction of air flow. This results in a spine free area 34' on both sides of the tube 28, one being on the upstream side and the other being on the downstream side. The advantages of this construction are stated more fully in the previously identified application of Failing, i.e., Ser. No. 06/641,474. As illustrated, the arc length of each row of spines 32 is approximately 90° while each spine free area 34' likewise has a 90° arc length.

Figure 7:
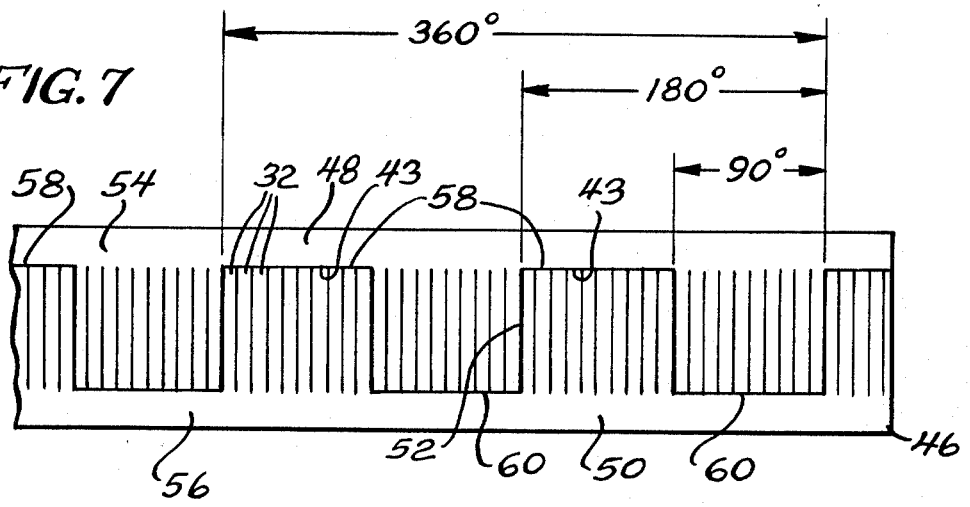
FIG. 7 is a view similar to FIG. 5 but illustrating a partially formed tape used in forming the segmented external fins on the tubes illustrated in FIG. 6.

FIG. 7 illustrates the forming a tape according to the method of the present invention for use in making the tube construction illustrated in FIG. 6. The same is generally identical to that described previously in connection with the description of FIG. 5 except that the longitudinal cuts 58 and 60 each have an arc length of but 90° rather than 180°. It will be appreciated that the separation of the sheet 46 illustrated in FIG. 7 into two parts and the wrapping of a tube 28 with the same will provide the construction illustrated in FIG. 6.

It should be noted that the arc lengths mentioned previously are approximate. Because the tapes are helically wound, if the tapes are not stretched during wrapping, the length of each complete convolution must be slightly greater than the circumference of the tube to achieve axial alignment of the finned and spine free area. Conversely, if the tapes are stretched during winding, a lesser tape length may be sufficiently increased by the stretching to achieve the desired alignment.

From the foregoing, it will be appreciated that the method of the present invention allows the manufacture of segmented, externally finned tubes for use in heat exchangers and having spine free areas in an economical fashion. Such material as is employed in forming the reliefs 43 can be recycled easily or, where the longitudinal cuts on opposite sides of the sheet have the same length and are related to the circumference of the tube upon which the tape is to be wrapped as mentioned previously, provides complete utilization of the entirety of each sheet 46.

In some instances where the cuts 58 and 60 are of unequal length, both tapes may nonetheless be used. For example, if the length "n" of the cut 58 is chosen to equal 140°, the two tapes formed from the sheet 46 will provide spined areas of 220° and 140°. The first or 220° tape could be used in a heat exchanger serving as an evaporator while the second or 140° tape could be used in forming a heat exchanger to serve as a condenser where the circumferential extent of the spines 32 has a lesser effect on heat exchange.

As a consequence, the material savings and other advantages that accompany the segmented, externally finned tubes disclosed in the previously identified applications of Hill and Failing are enhanced through the simple and economical method of formation of such tubes according to the present invention.

I claim:

1. A method of making a segmented externally finned tube with at least one fin free area for use in a heat exchanger comprising the steps of:

(a) providing a tape of thermally conductive material with spaced reliefs to form spine free areas along one longitudinal edge thereof while slitting the tape from said one edge partially across its length between said reliefs to form spine groups with the spine groups and the spine free areas being alternately spaced;

(b) bending the spine groups of the tape to form an angle with respect to the remainder of the tape; and (c) spirally wrapping a thermally conductive tube with the tape such that the spine groups of the tape extend outwardly from the tube and said remainder is in heat transfer relation with said tube with the spine groups being axially aligned along said tube.

2. The method of claim 1 wherein steps (b) and (c) are performed in sequence with step (c) following step (b).

3. The method of claim 1 wherein the tube employed in step (c) is of generally circular cross section.

4. The method of claim 1 wherein the slit portions between the reliefs are of equal length along the length of the tape and said reliefs are of equal length along the length of the tape and the sum of the lengths along the length of the tape of one spine groups and one relief is approximately equal to the circumference of the tube divided by an integer of one or more.

5. The method of claim 4 where the integer is one or two.

6. The method of claim 4 wherein the lengths of the reliefs and of the spine groups along the length of the tape are equal to each other.

7. A method of making a segmented externally finned tube with at least one fin free area for use in a heat exchanger comprising the steps of:

(a) providing between the longitudinal edges of an elongated sheet of thermally conductive material a series of slits across the sheet and forming longitudinal cuts inwardly of said longitudinal edges along the ends of the slits in alternating fashion on opposite sides of the sheet;

(b) separating the sheet into two tapes along the longitudinal cuts and certain of slits forming alternating spine free areas and spine groups;

(c) bending the spine group portions of each of said tapes to form an angle with respect to the remainder of the respective tape; and (d) helically wrapping both of said tapes on at least one thermally conductive tube such that the spine groups extend outwardly therefrom with the spine groups in axial alignment, and said remainders are in heat transfer relation with the tube on which they are wound.

8. The method of claim 7 wherein step (c) follows steps (a) and (b).

9. The method of claim 7 wherein said longitudinal cuts are all of equal length.

10. The method of claim 7 wherein the longitudinal cuts on one side of said sheet are of equal length.

11. The method of claim 7 wherein the sum of the length of one of the longitudinal cuts along on one side of the sheet, and the length of the next longitudinal cut on the opposite side of the sheet is approximately equal to the circumference of the tube divided by an integer of one or more.

12. The method of claim 7 wherein said slits are generally transverse to the direction of elongation of said sheet.

* * * * *